United States Patent [19]

Straub

[11] 4,067,240

[45] Jan. 10, 1978

[54] PROCESS OF SHOT PEENING AND CLEANING AND PREPARING SHOT PELLETS THEREFOR

[76] Inventor: John C. Straub, 2508 Lincolnway West, South Bend, Ind. 46628

[21] Appl. No.: 775,690

[22] Filed: Mar. 9, 1977

Related U.S. Application Data

[63] Continuation-in-part of Ser. No. 607,241, Aug. 25, 1975, Pat. No. 4,034,585.

[51] Int. Cl.[2] ..... B21D 31/00

[52] U.S. Cl. ..... 72/377; 29/1.22; 29/148.4 B; 72/53

[58] Field of Search ..... 72/377, 53, 40, 362; 29/1.22, 148.4 B

[56] References Cited

U.S. PATENT DOCUMENTS

| | | | |
|---|---|---|---|
| 2,077,639 | 4/1937 | Minich | 72/53 |
| 2,758,360 | 8/1956 | Shetler | 29/148.4 B |
| 3,073,022 | 1/1963 | Bush | 72/53 |
| 3,204,320 | 9/1965 | Eckstein | 29/148.4 B |
| 3,271,992 | 9/1966 | Stewart | 29/148.4 B |
| 3,316,748 | 5/1967 | Lang | 29/148.4 B |

FOREIGN PATENT DOCUMENTS

| | | | |
|---|---|---|---|
| 1,320,748 | 6/1973 | United Kingdom | 72/53 |

*Primary Examiner*—C.W. Lanham
*Assistant Examiner*—Gene P. Crosby
*Attorney, Agent, or Firm*—Oltsch & Knoblock

[57] ABSTRACT

A process of compression stressing shot pellets to increase the fatigue strength or resistance thereof to brittle fractures by impact of the pellets during shot peening and cleaning operations wherein the elastic radial tensile stress at the surface of the pellets is maintained at a safe low value during initial compression stressing and preparation for and performance of peening and cleaning operations. The process entails subjecting the pellets initially to compression stresses of sufficiently low value to avoid the spontaneous formation of superficial or surface cracks in pellets formed of notch sensitive material and then subjecting the pellets to stresses normal in shot peening and cleaning operations. The compression stresses occurring at the surface of the pellets in the initial step of the process minimize the likelihood of formation of surface cracks in the pellets when subsequently subjected to the greater impact forces to which the pellets are subject during peening and cleaning operations, thus increasing the life of the pellets.

7 Claims, 1 Drawing Figure

PROCESS OF SHOT PEENING AND CLEANING AND PREPARING SHOT PELLETS THEREFOR

SUMMARY OF THE INVENTION

This invention relates to a process of compression stressing shot pellets to increase the fatigue strength thereof and is a continuation in part of my copending application Ser. No. 607,241, filed Aug. 25, 1975, now U.S. Pat. No. 4,034,585 for "Process of Compression Stressing Metals to Increase the Fatigue Strength Thereof."

The process of shot peening metals has been used for increasing the fatigue strength of metals on a production basis for many years. One of the major factors responsible for the increased fatigue strength of metals when so processed is the presence of a residual compressive stress of high magnitude in the surface of the part. In a metal part which does not contain such residual compressive stress in the surface, fatigue failure will start at the surface thereof. Such fatigue failure is the result of repeated cycles of applied stress; that is, it occurs from fluctuation of the magnitude of the applied stress, or its direction, as between tensile stress or compressive stress, or both. The degree of change in stress during the stress cycle will influence the life before fatigue failure, as will also the magnitude of the maximum tensile stress during the cycle. The higher the maximum tensile stress the sooner fatigue failure will occur in terms of numbers of cycles. Fatigue failure is a brittle type of fracture which occurs substantially without plastic deformation in the area of fracture. Brittle fracture can occur as the result of a single application of high tensile stress. Such fracture can occur in a work piece or in the shot pellets employed in a peening or cleaning operation.

Shot peening generally is not recognized as a means of increasing the resistance of a component to yield as the result of a single cycle of high tensile stress. It follows then that insofar as the surface of the part is concerned a residual compressive stress at the surface will reduce the magnitude of the resultant tensile stress since the resultant stress is the algebraic sum of the tensile stress and the compressive stress. It is also known that a residual compressive stress in a metal part cannot exist without a corresponding residual tensile stress therein which results the compressive stress.

A compression stressed metal part, whether a work piece being shot peened or cleaned or a shot pellet used in the peening or cleaning operation, may be subject to failure either at the surface or below the surface, depending upon the distribution of the applied stress, the distribution of the residual stresses, the notch sensitivity of the material, and other factors. Fatigue failure is most likely to occur at the depth where the maximum resultant tensile stress of the part is greatest in relation to the fatigue strength of the material at that depth. The fatigue strength of the material is influenced by some function of the physical properties of the material and varies according to the composition of the material. Accordingly, it has been usual heretofore in selecting shot pellets, which are commonly formed of cast steel, to employ pellets whose hardness does not exceed 45 Rc(Rockwell).

I have found that it is possible to obtain a gain in fatigue strength of shot pellets of a hardness exceeding 45 Rc, as those in the range from 50 to 62 Rc, by compression stressing the pellets under conditions different from those currently practiced.

I have found that the location of the maximum residual compressive stress in a work piece being peened and in the pellets employed depends upon the yield strength of the metal thereof, particularly in materials of 50 Rc or above. Such maximum residual compression stress depends upon the velocity of the shot striking a work piece or other object. There is a complex relationship of the factors involved, such as the properties of the metal, the range of hardness involved, and the stress cycle involved in the service of the part being worked, such as complete reversal of stress or zero to maximum stress. Other involved factors are peening and working conditions, such as the shot diameter, the velocity of the shot, and the hardness of the shot, and the degree of coverage of a work piece by the shot, and the degree of coverage of the surface area of the shot which is exposed to impact.

The compressive stressing of metals entails plastic flow of the metal being processed. This plastic flow during pellet working and during peening or cleaning is always maximum below the surface, but in cases where the depth of maximum flow is sufficiently shallow the residual compressive stress caused by that flow will be substantially maximum at or slightly below the surface. Another factor to be considered with metals of work pieces or shot pellets of high strength is the magnitude of the radial tensile stress on the surface of the metal occurring at or adjacent to the edge or periphery of the circular area of contact between the substantially spherical shot and a metal part during impact. This stress may be excessive before subsurface yield occurs and thus may result in damage to the notch sensitive surface of the metal part or the shot, particularly with relation to components with homogenous hardness. In considering the last named factor in a ductile material, the magnitude of radial tensile stress occurring at the surface of the part is relatively low when massive yield occurs in the subsurface region, and this yield gradually spreads and causes a residual compressive stress on the surface. This takes place before the elastic radial tensile stress becomes excessive. The radial tensile stress is about 40% of the maximum elastic shear stress which causes the initial plastic flow below the surface. In ductile metals compressive stress is set up in the surface before the radial tensile stress becomes significant, and, therefore, no cracks develop at the surface.

With metals of high hardness, such as 50 Rc or more, higher elastic stresses, including the radial tensile stress at the surface at the edge of the area of contact between the shot and the work, will occur before subsurface yield occurs during impact. Calculations I have derived indicate that, as the hardness of the metal increases, the magnitude of the elastic strength stress prior to subsurface yield increases; and the higher the hardness the higher the notch sensitivity to the metal, so that cracks are likely to develop in the sudden application of this radial tensile stress.

As a result of my investigations I have found that it is possible and it is the primary object of this invention to obtain a substantial gain in fatigue strength of shot pellets by choice of conditions of compression stressing thereof in one or more stages to obtain distribution of residual stresses in the metal not heretofore attained in the preparation of or in the use of metal shot pellets.

A further object of the invention is to provide a process for treating shot pellets under predetermined conditions of impact which will produce a distribution of residual stresses for substantially greater reduction of maximum tensile stress.

A further object is to provide a process of compression stressing metal shot in one or more stages under conditions which will cause a maximum plastic flow of the metal thereof to occur at a depth which will produce an advantageous distribution of residual stresses to increase the fatigue strength thereof.

A further object is to provide a process of compression stressing metal shot in one or more stages which will produce a favorable distribution of residual stresses in the metal thereof without the occurrence of damage to the surface in the form of cracks in the metal.

A further object is to provide a process wherein repeated impact of shot pellets upon a hard target at a selected low value occurs for a sufficient number of times to produce a compressive stress of shallow depth on substantially the entire surface of each pellet.

A further object is to provide a method of compression stressing metal shot of high hardness and notch sensitivity so as to reduce the effect of the notch sensitivity thereof and to prolong the use of the shot in shot peening and cleaning operations.

Other objects will be apparent from the following specification.

In the drawing:

FIG. 1 illustrates apparatus which may be used in the first step of my method of treating shot pellets.

DESCRIPTION OF THE PREFERRED EMBODIMENT

Figure 1:
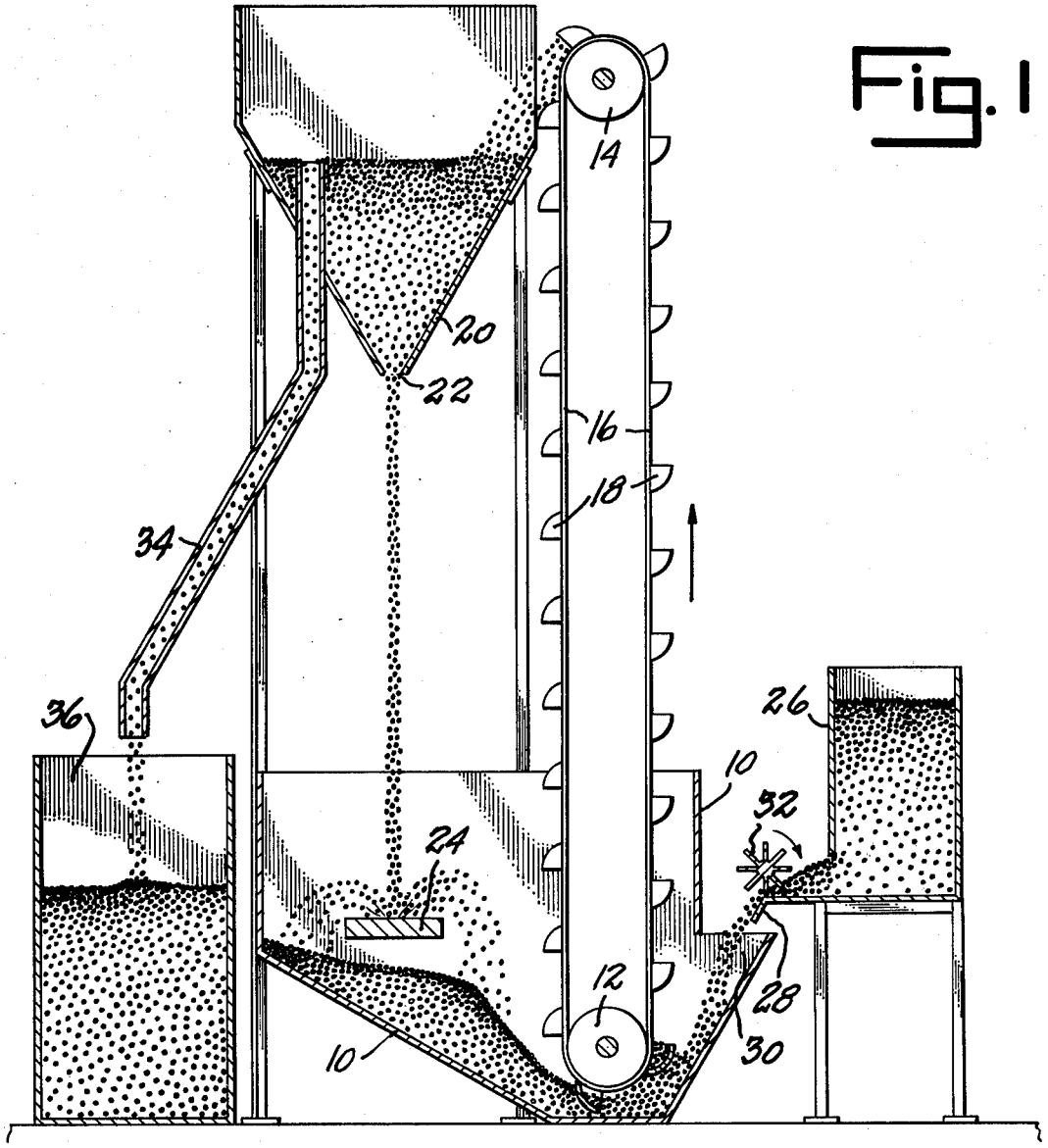

This method entails the control of conditions of processing shot pellets to ensure that the elastic radial tensile stress of the shot pellets is at a safe low value at the time when subsurface yield incident to compression stressing occurs during normal peening and cleaning operations.

In one embodiment of the process two or more conditions affecting the shot pellets are involved or practiced. Thus an initial stage or step in the process entails subjecting the shot pellets to impacts at a velocity low enough to avoid formation of superficial or surface cracks during the operation. This is particularly important when dealing with shot pellets of high strength steel. I have found that the occurrence of surface cracks in shot pellets during a peening operation is the result of the elastic radial tensile stress due to impact. This tensile stress is primarily dependent upon the velocity of the shot and is substantially independent of the size of the shot as long as the action of impact is entirely elastic. As soon as subsurface shear stress exceeds the yield strength of the metal in the shot pellets, plastic flow begins at the point of excess and spreads gradually. The spread of the plastic flow is predominantly toward a greater depth, but to some extent occurs also toward the surface. The subsurface shear stress occurs directly below the center of contact of the shot pellet on a work piece or a target, and cracks are not likely to occur at that point because of the three dimensional support of the solid material around the center of contact, even though at the instant of first yield, the magnitude of the contact compressive stress at the center point is greater than the subsurface shear stress. At the same instant the radial tensile stress which occurs at the edge or margin of contact, even though much smaller than the subsurface shear stress, may occur at an exposed surface at which cracks may occur. This, of course, does not imply that the radial tensile stress does not increase after the instant of first yield. In view of the last named factors, the initial stage in the practice of my method should be such that plastic flow of the metal begins before the radial tensile stress becomes excessive, i.e. it occurs at a sufficiently shallow depth to produce a residual compressive stress at the surface of the work or the shot pellet. The residual compressive stress at the surface need not be of high magnitude or of great depth compared to that which occurs in the final shot peened product or in shot pellets which have been used in my method; and, consequently, the initial stage can be accomplished at a low shot velocity, such as a velocity in the range of 24 feet per second to 30 feet per second. This low velocity initial stage of impact serves to protect the surface of the shot pellets against cracks.

The initial stage of the process in which the shot pellets are subjected to impact substantially less severe than that experienced by the shot pellets in the service of peening and cleaning is continued until a compressive stress is applied upon substantially all of the surface of each of the shot pellets. The method can be applied in the treatment of shot pellets of a hardness substantially greater than the pellets normally employed, that is, greater than 45 Rc; for example, of a hardness of up to 62 Rc, despite the fact that it has been known by shot manufacturers and users that shot pellets of such hardness normally have a life in peening operations substantially shorter than the life of shot pellets with the commonly used hardness in the order of 45 Rc. In other words, despite the fact that the physical properties, such as yield strength and ultimate strength of shot pellets of hardness greater than 45 Rc are much higher than the physical properties of shot pellets of a hardness of 45 Rc, the normal life of such shot pellets of high hardness is shorter than the life of shot pellets of a usual hardness of 45 Rc.

In the initial stage of my process shot pellets are accelerated by any conventional means and directed against a hard target. The accelerating means may be a centrifugal wheel, a compressed air nozzle, or even gravity in free fall. Processing in the initial stage utilizing acceleration of the pellets by free fall is illustrated in the drawing.

The apparatus illustrated in the drawing entails the use of a lower hopper 10 containing shot pellets to be processed. Within the hopper 10 is mounted the lower end of a conveyor or elevator which may include a lower roller, pulley or sprocket 12 journaled in the hopper. An upper pulley, roller or sprocket 14 is journaled at a selected elevation above hopper 10. The conveyor may include a belt or chain 16 trained around the pulleys or sprockets 12 and 14 and carrying or mounting a plurality of cups or receptacles 18 substantially uniformly spaced along its length. Suitable drive means (not shown) are provided for driving one or both of the pulleys or sprockets 12, 14 and the belt or chain 16 so that the upwardly moving flight thereof has the cups or containers 18 thereon so positioned as to carry shot pellets scooped from the lower hopper upwardly to and around the upper pulley or sprocket 14. A storage hopper 20 is positioned alongside the conveyor in such a position that shot pellets which are discharged from the cups 18 as they pass around the upper pulley or sprocket 14 are discharged into the hopper 20. The upper or storage hopper has a discharge outlet 22 positioned at selected elevation above the lower hopper, and, in particular, in a selected spaced relation, such as 14 feet, above a target member 24 carried by the lower hopper 10, which target 14 is located for impact of shot pellets discharged through the outlet 22 of the upper hopper 20. The target member is substantially horizontally positioned and is of a material of a hardness preferably equal to or greater than the hardness of the shot pellets. It will be seen that the spacing between the outlet 22 of the upper hopper 20 and the target 24 will determine the impact of the shot pellets as they strike the target 24. This impact, when that spacing is in the order of 14 feet, is substantially less than the normal speed of impact of the shot pellets against a work piece during normal shot peening and cleaning operations. It will be apparent that when the conveyor of the device illustrated operates, a continuous cycle occurs during which shot pellets are repeatedly subjected to impact with the target 24, and that after a short period of operation each of the pellets will have been impacted against the target member a number of times so that all or a substantial portion of the surface of each pellet will have been subjected to impacts to provide a substantially uniform compressive stress throughout the surface of each pellet.

The apparatus may be provided with means for adding, at a selected rate, new or unprocessed shot pellets to the supply of shot pellets already in circulation. Such means are illustrated in the nature of a hopper 26 for the shot to be processed. Hopper 26 has an outlet or guide 28 positioned to discharge shot pellets into the lower hopper, as at part 30, under control of means 32 to regulate the rate of such discharge. Such regulating means 32 may constitute a driven roller with radially projecting vanes or paddles for advancing shot pellets from the container 26 to the discharge 28, the rate of discharge being controlled by the rate of speed at which the part 32 functions.

The device is completed by an overflow pipe 34 carried by and projecting to a selected level within the upper hopper 20 and directed to discharge into a bin or other container 36 the initially processed shot pellets. Both ends of the tube 34 are open, and the upper end thereof is positioned at a level in the upper hopper 20 spaced below the point of discharge of shot pellets into the hopper 20 from the conveyor 16.

It will be apparent that, after an initial period of operation of the conveyor sufficient to cause treatment and impacting of a substantial portion of the surface of each shot pellet by impact with the target 24, the device 32 may be actuated to start supply of additional shot pellets from the container 26 into the lower hopper 10 at a selected rate, whereby the number of shot pellets which are in circulation in the apparatus is progressively increased. When the level of the shot pellets in the upper hopper 20 around conduit 34 is higher than the upper open end of the conduit 34, shot pellets will overflow through conduit 34 for discharge into the receptacle 36, thus gradually withdrawing the initially processed shot pellets. After a selected period of time the operation of the device may be stopped and substantially all of the pellets remaining in the apparatus will have been initially processed to substantially uniformly compressively stress the surface of all pellets.

While the apparatus illustrated in FIG. 1 may be employed for the initial processing of the pellets to prepare them for use in shot peening and cleaning operations, any other apparatus will be found suitable or convenient and may be utilized for that purpose if it includes means to control the speed at which shot pellets are discharged or impacted against a target and that operation thereof continues until substantially all of the surface of each pellet has been initially compressed.

The range of variation in the practice of initial processing according to my method is great because of the wide variety of materials, dimensions and apparatus used therein; and, consequently, it is impossible to enumerate every variation.

The second step of the method entails impacting of shot pellets against a hard target at greater speed, such as that usual in normal shot peening or cleaning operations. Examples indicating the range of shot size and velocity used in the second step as applied to different types of work pieces are given below. It should be understood that each example given represents a range of choice of conditions rather than a range for a particular application. It is good peening practice, where possible, to control the shot size and velocity to a reasonably uniform value; that is, to use one standard shot size at a substantially constant velocity in a given peening operation.

EXAMPLE 1

Steel leaf spring 1/16 inch thick, of a hardness in the range from 45 Tc to 62 Rc. The service required of the spring is to sustain an applied stress cycle entailing bending from zero to maximum tensile stress, and a long useful life under such conditions. By my method, a single stage of shot peening using substantially spherical shot of hardness of 55 to 60 Rc in the size range from S-110 (0.011 inch diameter) to S-280 (0.028 inch diameter) impacting the work piece at a velocity of from 24 to 30 feet per second with substantially full coverage of the work will suffice. I have found that cracks are not likely to occur in the surface of such components and that the depth of residual compressive stress obtained by such processing is adequate for this thickness of the work piece.

EXAMPLE 2

Steel leaf spring ⅛ inch thick of hardness in the range from 50 to 62 Rc. The service required of the spring is to sustain an applied stress cycle entailing bending from zero to maximum tensile stress. I first subject the piece to peening using shot of hardness of 55 to 60 Rc in the size range from S-110 (0.011 inch diameter) to S-230 (0.023 inch diameter) impacting the work at a velocity in the range of 24 to 30 feet per second, to secure substantially full coverage of the work piece. The work piece is then subjected to a second peening stage using shot of the same size and hardness range used in the first stage impacting the work at a velocity in the range from 233 to 90 feet per second, with the smallest shot inpacting at a velocity higher in that range and larger shot impacting at a lower velocity in that range. Practice of this example of the method eliminates likelihood of surface cracks and produces a depth of residual compressive stress adequate for the thickness of the component.

EXAMPLE 3

A steel leaf spring of a thickness of ¼ inch and a hardness in the range from 50 to 62 Rc which in service requires a long life when subjected to an applied stress cycle entailing bending from zero to maximum tensile stress. This component is first subjected to shot peening using shot of hardness of 55 to 60 Rc in the size range from S-110 (0.011 inch diameter) to S-330 (0.033 inch diameter) projected against the component at a velocity in the range from 24 to 30 feet per second to secure substantially full coverage of the component. The component is then subjected to shot peening using shot of hardness from 55 to 60 Rc in the size range from S-170 to S-330 projected against the component at velocities in the range from 233 feet per second to 90 feet per second, with the velocity inversely related to the size of the shot used. Peening continues until full coverage of the component occurs.

EXAMPLE 4

A component of ½ inch thickness and a hardness of 50 to 62 Rc is first subjected to shot peening using shot of a hardness of 55 to 60 Rc in the size range from S-110 (0.011 inch diameter) to S-460 (0.046 inch diameter) projected against the work piece at a velocity in the range from 24 to 30 feet per second to secure substantially full coverage of the work. The work piece is then subjected to shot peening using shot of hardness from 55 to 60 Rc in the size range from S-230 to S-460 projected against the work at a velocity in the range from 233 feet per second to 90 feet per second, with the velocity inversely related to the size of the shot used. Peening continues until full coverage of the surface of the work occurs.

EXAMPLE 5

A metal component of 1 inch thickness and of a hardness of 50 to 62 Rc is subjected to a first stage of peening with shot of hardness from 55 to 62 Rc in the size range from S-110 to S-660 (0.066 inch diameter) at a velocity of 24 to 30 feet per second to secure substantially full coverage of the surface of the work piece. The work piece is then subjected to a second stage using shot of the same hardness and of a size in the range from S-460 to S-660 projected against the work piece at a velocity in the range from 233 feet per second to 90 feet per second until the entire surface of the work has been peened. The velocity of the shot is inversely proportional to the size of the shot used.

With regard to Example No. 5, the use of shot size of S-660 and the velocity of 233 feet per second are in the low range and higher velocity and larger shot size can be used, but limitations in currently available equipment dictate the shot size and velocity indicated. If equipment becomes commercially available to handle larger shot sizes at higher velocities than indicated, the range of shot size and velocity obtainable with such equipment could be determined readily by simple tests. Also, with respect to the process of Example No. 5, since the likelihood of occurrence of cracks on the surface of the work is influenced by the velocity of the shot, the same shot could be used in both stages of the process subject to the disadvantage that the use of large shot, such as S-660, at the low velocity of the first stage may require an extremely long exposure time in the first stage.

In considering the foregoing examples, it will be understood that they are illustrative and not limiting, and that they are effective in treating work pieces which may be subjected to all types of stresses, including complete reversal, as between tensile stress and compressive stress. Also, it will be understood that the velocity referred to in the examples relates to the velocity of shot projected in a direction substantially at right angles to the surface of the work piece. This does not mean that the shot peening must be accomplished with right angle impact, but rather that, at a smaller angle of impact, the force of impact is reduced, and suitable compensation for such reduction must be made.

The present method for the first time makes it possible to utilize materials of high strength and hardness commonly referred to as "brittle materials" as work pieces, and also to use shot pellets of materials of higher strength and hardness than heretofore usable. It will be noted that the velocity of the shot pellets used in the first stage of the process is lower than the velocities used in the second stage of the process, and lower than is conventionally used in blast cleaning and shot peening. Also, it will be noted that in the first stage of the multi-stage processes the shot velocity rather than the shot size is the predominant factor in preventing cracks in the shot pellets.

While the preferred procedures in the practice of the method have been indicated, it will be understood that the invention is not limited to the examples given, but, rather, falls within the scope of the appended claims.

What I claim is:

1. In a process of compression stressing shot pellets for use in shot peening and cleaning operations, the step of imparting residual compressive stresses to substantially the entire surface of each pellet before use thereof in a peening or cleaning operation, said stresses being imparted to said pellets by impact of a value less than that to which the pellets are subjected in peening and cleaning operations and so related to the hardness and notch sensitivity of the metal of the pellets as to stress the surfaces of the pellets without creating cracks in the surfaces of the pellets and to produce a distribution of residual stresses in the pellets favorable to increase of fatigue strength thereof.

2. The method defined in claim 1, wherein the shot pellets are impacted against a member of at least substantially equal hardness at a velocity in the order of 24 feet per second to 30 feet per second.

3. The method defined in claim 1, wherein the shot pellets are formed of metal of hardenss in the range of 45 to 62 Rc and are impacted against a member of substantially similar hardness at a velocity in the order of 24 feet per second to 30 feet per second.

4. The method defined in claim 1, and the additional step of further compression stressing the surfaces of said initially stressed pellets at an intensity substantially greater than the intensity of said initial stressing thereof and of a value to prevent formation of cracks in the pellets.

5. The method defined in claim 4, wherein the shot pellets are of a diameter in the range from 0.011 inches to 0.066 inches and are projected against a work piece in the additional step at a velocity in the range from 233 feet per second to 90 feet per second selected in inverse proportion to the diameter of the shot pellets.

6. The method of increasing the fatigue life of metal shot pellets which comprises compression substantially the entire surfaces of said pellets at a low intensity in a first step and thereafter further compression stressing the surfaces of said pellets in a second step at an intensity substantially greater than the intensity of said initial stressing thereof, said first step compression stressing being of an intensity to prevent the formation of cracks in the pellets during the first step and during higher intensity compression stressing in the second step.

7. The method defined in claim 6, wherein the first compression stressing of the pellets is of a magnitude to produce plastic flow at the surfaces of the pellets sufficient to protect the surfaces of the pellets against occurrence of cracks during the second compression stressing of the pellets in which a greater depth of compressive stress in the pellets is produced.

* * * * *

UNITED STATES PATENT AND TRADEMARK OFFICE

CERTIFICATE OF CORRECTION

PATENT NO. : 4,067,240

DATED : January 10, 1978

INVENTOR(S) : John C. Straub

It is certified that error appears in the above-identified patent and that said Letters Patent are hereby corrected as shown below:

Claim 6, line 2, after "compression" insert--stressing--

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*